US006364380B2

(12) United States Patent
Franz

(10) Patent No.: US 6,364,380 B2
(45) Date of Patent: Apr. 2, 2002

(54) CLOSING DEVICE, PARTICULARLY FOR THE TRUNK OF A MOTOR VEHICLE

(75) Inventor: Erhard Franz, Rödermark (DE)

(73) Assignee: Mannesmann VDO AG, Frankfurt (DE)

( * ) Notice: Subject to any disclaimer, the term of this patent is extended or adjusted under 35 U.S.C. 154(b) by 0 days.

(21) Appl. No.: 09/775,268

(22) Filed: Feb. 1, 2001

Related U.S. Application Data

(63) Continuation of application No. 08/988,797, filed on Dec. 11, 1997, now abandoned.

(30) Foreign Application Priority Data

Dec. 24, 1996 (DE) ..... 196 54 380

(51) Int. Cl.[7] ..... E05C 3/12

(52) U.S. Cl. ..... 292/219; 292/341.17; 292/DIG. 45; 292/DIG. 42

(58) Field of Search ..... 70/451–455, 423, 70/370, 371, DIG. 56; 292/13, 44, 54, 228, 219, DIG. 42, DIG. 43, DIG. 45, DIG. 55, 341.17, 341.15; 49/394, 503; 312/328, 329

(56) References Cited

U.S. PATENT DOCUMENTS 5,295,720 A * 3/1994 Budde ..... 292/201

* cited by examiner

*Primary Examiner*—Lynne H. Browne
*Assistant Examiner*—John B. Walsh
(74) *Attorney, Agent, or Firm*—Martin A. Farber

(57) ABSTRACT

A closing device, in particular for the trunk of a motor vehicle, having a closure bolt (2) arranged on a support (1) and guide elements (3) to receive a lock mechanism, the guide elements (3) being, movable on the support (1), in particular swingable around an axis of rotation (4).

15 Claims, 1 Drawing Sheet

CLOSING DEVICE, PARTICULARLY FOR THE TRUNK OF A MOTOR VEHICLE

RELATED APPLICATION

Figure 1:
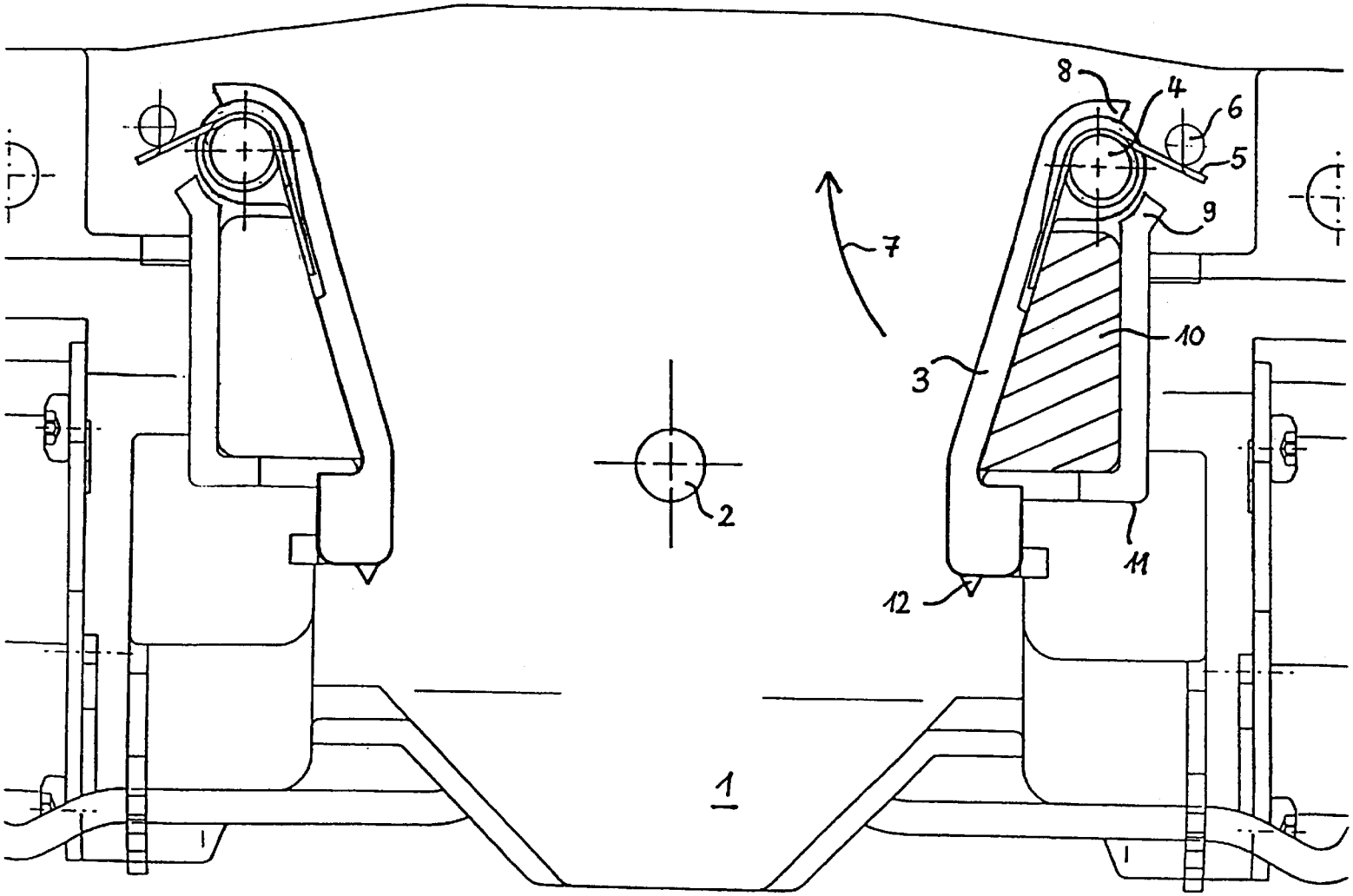

This application is a continuation of my application Ser. No. 08/988,797 filed Dec. 11, 1997 now abandoned.

FIELD AND BACKGROUND OF THE INVENTION

The present invention relates to a closing device, in particular for the trunk of a motor vehicle.

A closing device is known from EP 0 565 929 A1. A closure bolt which is gripped by a rotary trap of a lock mechanism upon the closing of a door, trunk, or the like is arranged on a support. Upon the closing process, the lock mechanism, which contains lock elements such as rotary latch, pawl and further elements, is guided by guide elements which are also arranged—adapted to the trapezoidal development of the lock mechanism—on the support. The support, the guide elements, and possibly a part of the body of the car which is arranged parallel to the support above the guide elements, form a shaft to receive the lock mechanism into which dirt can enter, which then impairs the operation of the lock mechanism. Furthermore, this shaft or else, if no shaft is present, the protruding closure bolt and possibly the guide elements constitute a source of injury upon the use of the motor vehicle.

SUMMARY OF THE INVENTION

The object of the invention is therefore to provide a closing device by which dirtying and the risk of injuries are effectively avoided.

This object is achieved in accordance with the invention by the features that guide elements (3) are arranged movably on the support (1) with each being swingable about an axis of rotation (4). The mobility of the guide elements arranged on the support has the advantage that, in the event that the lock mechanism is not within the shaft or between the guide elements and adjoins the closure bolt, the shaft is closed and thus no dirt can enter the shaft. Thus, it is also not accessible to service personnel, so that the risk of injuries is also excluded. In addition, the possibility of closing the shaft, particularly when the door, trunk or the like has been opened, has a pleasing optical effect. A longitudinal movement (displacement) of the guide elements can also be thought of for the freeing of the shaft upon the introduction.

With the above and other objects and advantages in view, the present invention will become more clearly understood in connection with the detailed description of a preferred embodiment, when considered with the accompanying drawing, of which the sole FIGURE, namely FIG. 1, is an elevation view, partially sectioned, of a closure device for the lid of an automobile trunk.

DETAILED DESCRIPTION OF THE PREFERRED EMBODIMENT

FIG. 1 shows, as part of the entire closing device, a support 1 on which a closure bolt 2 is arranged. The lock mechanism (not shown here), which comprises, for instance, rotary latch, pawl, and other known parts, is moved, viewed in FIG. 1, from above in the direction towards the closure bolt 2, in which connection the movement of the guide elements 3 arranged on the support 1, which are movable around an their respective axis of rotation 4 are swung out. By this movement of the guide elements 3 around their respective axis of rotation 4, the shaft for the lock mechanism is freed of it and the closing device can be brought into its closed position, in which, for instance, a rotary trap grips around the closure bolt 2.

When the rotary trap has been released by a pawl, the lock mechanism moves again out of the shaft. The guide elements 3 at first follow along in this movement since they are acted on by force. This takes place, in FIG. 1 for each guide element 3, by means of a spring 5 which rests, on the one hand, against the guide element 3, and, on the other hand, against a resting point 6 on the support 1. The movement of the guide elements 3 in a direction of rotation 7 takes place up to a point at which an end 8 of the corresponding guide element 3 comes against a stop 9 which is also arranged on the support 1 and thus stops the rotation of the corresponding guide element 3. Thus the corresponding guide element 3, acted on by force (by means of the spring 5), is brought into a first position, in which the shaft is closed, and brought by the lock mechanism into a further position in which the shaft of the lock mechanism is accessible.

In order to dampen a closing of the closing device, a damping element 10 is provided, which is either fastened (glued, screwed, clamped or the like) on the guide element 3 or is fastened in the same way on the support 1, in particular on an arm 11 arranged on the support 1. The damping element 10 is preferably fastened on an arm 11 and thus remains in a position of rest, so that, upon the movement of the guide elements 3, the moving masses are reduced. Furthermore, it can be provided that at least the part of the surface of the guide element 3, which covers the shaft or comes into contact with the lock mechanism, be painted and/or provided with a coating in order effectively to reduce mechanical wear and increase the useful life.

Further embodiments of the invention are conceivable, without going beyond the inventive concept. Thus, for instance, with a suitable design, the spring 5 can at the same time assume the task of pretensioning and the task of damping. In this case, further elements for the action of force on the guide elements are possible, such as, for instance, compression springs, hydraulic cylinders or the like. A hydraulic cylinder of a compressed air cylinder can, for instance, also be used as damping element.

Furthermore, the structure shown in FIG. 1 can be developed with the elements such as support 1, closure bolt 2 and the other elements described and shown as a preassembled module. It is furthermore contemplated that the guide elements 3, including the elements corresponding thereto, be arranged symmetrically to the closure bolt 2 or to the direction of movement of the lock mechanism (as is shown in FIG. 1). On the end facing away from the stop 8 of the guide element 3 there is a sealing lip 12 which, in particular, is elastically deformable and closes the region of impact between the two guide elements 3. A tightening aid by which, for instance, the closure bolt 2 can be driven around an eccentric axis can also be used.

A preferred use of the closure means of the invention is for the trunk of motor vehicles, these uses not representing the only field of use.

What is claimed is:

1. A locking device, suitable for a trunk of a motor vehicle, the device comprising:

a support, and a closure bolt disposed on the support, a trunk door having a lock mechanism for engagement with the closure bolt upon a movement of the trunk door in a closing movement toward the closure bolt;

a plurality of guide elements disposed on the support on opposite sides of the closure bolt for receiving the lock mechanism upon said closing movement of the trunk door;

wherein the guide elements are disposed movably on the support to compensate for a presence of dirt on the lock mechanism;

wherein the guide elements are adapted to be brought, acted on by force into a first position, and are adapted to be brought by the lock mechanism into a further position upon the movement of the trunk door; and wherein said force, for each of said guide elements, is provided by a spring.

2. A device according to claim 1, wherein the guide elements are arranged symmetrically to a direction of movement of the lock mechanism.

3. A device according to claim 1, wherein the guide elements have, at least in part, a painting.

4. A device according to claim 1, further comprising a rear stop on said support, wherein the guide elements, in their first position, come to rest against said stop.

5. A device according to claim 1, wherein the guide elements have, at least in part, a coating.

6. A device according to claim 1, further comprising damping elements which come to rest on the support, and are fastened on the guide elements.

7. A device according to claim 1, further comprising damping elements which come to rest on respective ones of the guide elements and are fastened on the support.

8. A device according to claim 1, further comprising a plurality of sealing lips arranged on respective ends of the guide elements, and facing away from respective axes of rotation of the guide elements which guide elements are rotatable.

9. A device according to claim 1, further comprising a module containing the lock mechanism and the support with the parts of the device arranged thereon.

10. A device according to claim 1, wherein each of said guide elements is pivoted to said support about an axis of rotation.

11. A locking device, suitable for a trunk of a motor vehicle, the device comprising:

a support, a closure bolt disposed on the support, and a lock mechanism engagable with the closure bolt;

a plurality of guide elements disposed on the support on opposite sides of the closure bolt; and wherein the guide elements are disposed movably on the support between a first position into which first position the guide elements are spring-biased by a spring and a second position; and upon attachment of the locking device to the trunk, the lock mechanism is located on a trunk door, engagement of the lock mechanism with the closure bolt occurs during a closing movement of the trunk door, the guide elements define a receiving space for the trunk door during the closing movement of the trunk door, said first and said second positions of said guide elements serve respectively to close the receiving space and to open the receiving space, and the lock mechanism engages with the closure bolt upon a closing of the trunk door.

12. A device according to claim 11, wherein, upon attachment of the locking device to the trunk said guide elements engage with the trunk door and the lock mechanism to align the lock mechanism with the closure bolt during a closing movement of the trunk door.

13. A locking device, suitable for a trunk of a motor vehicle, the device comprising:

a support, and a closure bolt disposed on the support, a trunk door having a lock mechanism for engagement with the closure bolt upon a movement of the trunk door in a closing movement toward the closure bolt;

a plurality of guide elements disposed on the support on opposite sides of the closure bolt for receiving the lock mechanism upon said closing movement of the trunk door;

wherein the guide elements are disposed movably on the support to compensate for a presence of dirt on the lock mechanism;

wherein the guide elements are adapted to be brought, acted on by force into a first position, and are adapted to be brought by the lock mechanism into a further position upon the movement of the trunk door; and a plurality of springs, wherein said force, for respective ones of said guide elements, is provided by a respective one of said springs.

14. A locking device, suitable for a trunk of a motor vehicle, the device comprising:

a support, and a closure bolt disposed on the support, a trunk door having a lock mechanism for engagement with the closure bolt upon a movement of the trunk door in a closing movement toward the closure bolt;

a plurality of guide elements disposed on the support on opposite sides of the closure bolt for receiving the lock mechanism upon said closing movement of the trunk door;

wherein the guide elements are disposed movably on the support to compensate for a presence of dirt on the lock mechanism;

a plurality of arms arranged on the support;

a plurality of damping elements corresponding to respective ones of the guide elements; and wherein respective ones of the damping elements are secured to the guide elements and come to rest upon respective ones of the arms during a pivoting of the guide elements.

15. A locking device, suitable for a trunk of a motor vehicle, the device comprising:

a support, and a closure bolt disposed on the support, a trunk door having a lock mechanism for engagement with the closure bolt upon a movement of the trunk door in a closing movement toward the closure bolt;

a plurality of guide elements disposed on the support on opposite sides of the closure bolt for receiving the lock mechanism upon said closing movement of the trunk door;

wherein the guide elements are disposed movably on the support to compensate for a presence of dirt on the lock mechanism;

a plurality of arms arranged on the support;

a plurality of damping elements corresponding to respective ones of the guide elements; and wherein respective ones of the damping elements are secured to respective ones of the arms and come to rest upon respective ones of the guide elements during a pivoting of the guide elements.

* * * * *